United States Patent [19]

Carpenter

[11] Patent Number: 4,520,740

[45] Date of Patent: Jun. 4, 1985

[54] COMBUSTION AND HEATING EQUIPMENT

[75] Inventor: Brian M. Carpenter, Cheltenham, England

[73] Assignee: Coal Industry (Patents) Limited, London, England

[21] Appl. No.: 477,439

[22] Filed: Mar. 21, 1983

[30] Foreign Application Priority Data

Apr. 20, 1982 [GB] United Kingdom ..... 8211373

[51] Int. Cl.[3] ..... F23K 3/10

[52] U.S. Cl. ..... 110/288; 110/110; 110/233; 110/283; 110/318; 110/327; 237/50

[58] Field of Search ..... 126/107; 110/101 R, 110/108, 109, 110, 281, 282, 283, 286, 287, 288, 290, 292, 267, 233, 318, 327; 237/50

[56] References Cited

U.S. PATENT DOCUMENTS

| | | | |
|---|---|---|---|
| 2,160,803 | 5/1939 | Goerg | 110/288 |
| 2,190,877 | 2/1940 | Lees | 110/286 |
| 2,262,079 | 11/1941 | Yarick | 110/286 |
| 2,315,070 | 3/1943 | McNaughton | 110/286 |
| 2,510,240 | 6/1950 | Mayo | 110/286 |
| 2,851,972 | 9/1958 | Campbell | 110/288 |
| 3,190,245 | 6/1965 | Huntington | 110/286 |
| 4,319,557 | 3/1982 | Siefmann et al. | 110/288 |
| 4,323,017 | 4/1982 | Harris | 110/267 |

FOREIGN PATENT DOCUMENTS

| | | |
|---|---|---|
| 218239 | 11/1924 | United Kingdom . |
| 281098 | 11/1927 | United Kingdom . |
| 472889 | 9/1937 | United Kingdom . |
| 477760 | 1/1938 | United Kingdom . |
| 510974 | 8/1939 | United Kingdom . |
| 535039 | 3/1941 | United Kingdom . |
| 1011159 | 11/1965 | United Kingdom . |
| 1041802 | 9/1966 | United Kingdom . |
| 1115741 | 5/1968 | United Kingdom . |
| 1153146 | 5/1969 | United Kingdom . |
| 2075666 | 11/1981 | United Kingdom . |

*Primary Examiner*—Edward G. Favors
*Assistant Examiner*—Steven E. Warner
*Attorney, Agent, or Firm*—Stevens, Davis, Miller & Mosher

[57] ABSTRACT

Combustion and heating equipment includes a body with an underfeed stoker located in the lower part thereof. A jacket surrounds the body to define a heating space, different parts of which are interconnected by triangular ducts disposed in the gas pass. A screwfeeder is provided for the retort of the stoker and extends right through the body terminating in an inlet 36. A mobile hopper has an outlet for registry with the inlet and is refillable and interchangeable.

9 Claims, 1 Drawing Figure

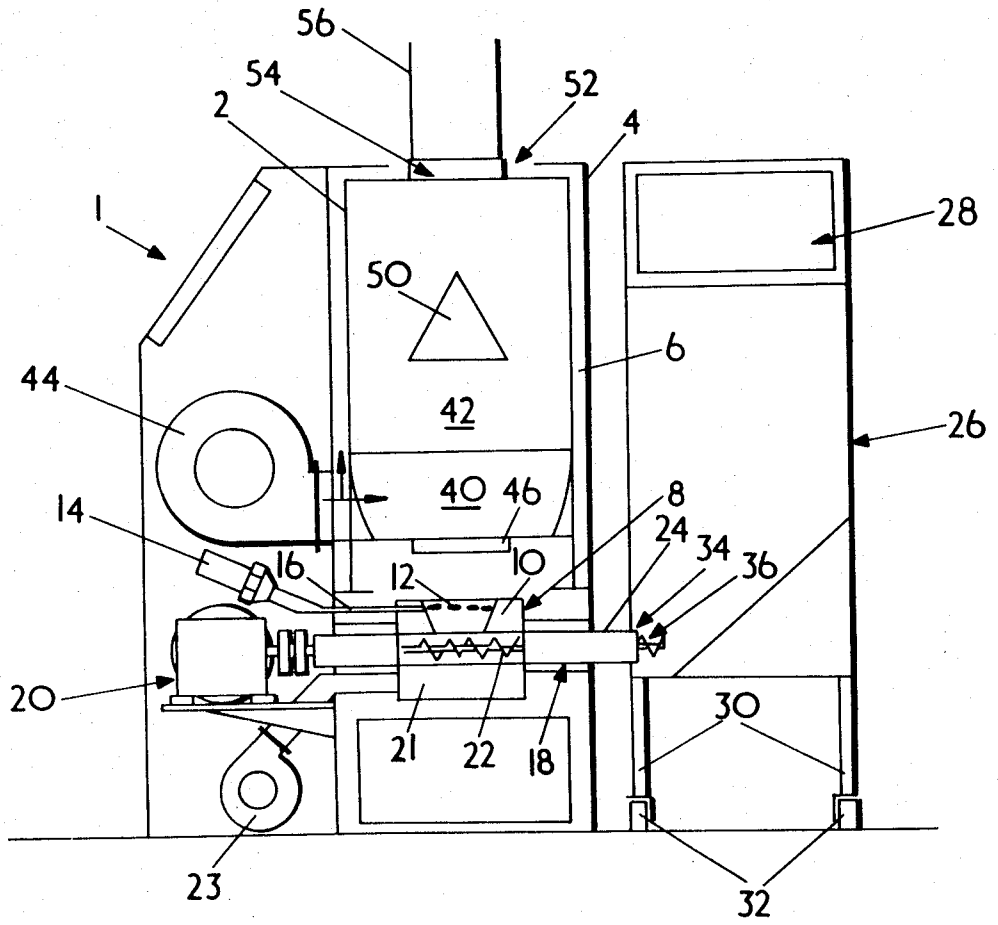
28
26
4
52
56
54
2
1
6
50
42
40
46
44
8
10
12
16
14
24
34
36
20
22
21
18
30
32
23

COMBUSTION AND HEATING EQUIPMENT

This invention concerns improvements in or relating to combustion and heating equipment.

In particular, the invention has reference to such equipment incorporating an underfeed stoker for burning solid fuel to generate heat to be transferred to a working fluid, for example air or water.

An object of the present invention is to provide improved combustion and heating equipment. According to one aspect of the present invention there is provided combustion and heating equipment including a body in the lower part of which is located an underfeed stoker, a jacket extending around the body to define a heating space therebetween, at least one duct disposed within the body above the underfeed stoker and interconnecting different parts of the heating space, means for causing flow of a working fluid through the heating space, and an outlet in the jacket for the working fluid.

Conveniently more than two or more ducts are disposed within the body above the underfeed stoker, the ducts being arranged at different levels within the combustion gas pass.

The or each duct may advantageously be of triangular section and in the case of more than one duct being provided, successive ducts may be orientated in dissimilar modes in order to promote in use turbulence of combustion gas around the ducts thus resulting in enhanced heat transfer. For example, in horizontal section through the body of the equipment a cruciform pattern of ducts may conveniently be adopted, the ducts being arranged at right angles to each other in succession.

An apex of the triangular duct may be arranged on the center line of the body and the included angle is such as to afford a natural self-cleaning capability. For example, the angle may be 60° thereby preventing a build-up of the particles usually carried by the combustion gases issuing from the underfeed stoker.

The choice of a triangular section is also advantageous in that the heat transfer area is optimized while the size of the equipment is maintained at a compact level. Furthermore, the cross-sectional area of the ducts is such that a low pressure drop is attained thereby enabling the utilization of a low pressure/high volume flow fan as the means for causing flow of the working fluid, for example air.

An overfire arch may be provided above the underfeed stoker and may conveniently be attached to the duct nearest to the stoker. It has been found that the provision of an overfire arch improves the combustion of fuel within the stoker and the assignee's co-pending U.K. patent application No. 82/10129, refers to a particular positional relationship between the arch and the retort of the underfeed stoker.

The underfeed stoker is preferably of the type described and claimed in the assignee's co-pending U.K. patent application No. 81/12510 and includes a self-ashing facility whereby ash and clinker formed as a result of the combustion process is discharged over the top of the retort and gravitates to a receiving unit disposed beneath the stoker retort thus obviating the need for an additional sidegrate de-ashing feature.

The underfeed stoker of the present invention has a screw-feeder for charging the retort and the flight of the screw may advantageously be of reverse hand, thus allowing fuel feed to take place from the opposite side of the stoker retort to that on which is located the drive arrangement for the feeder.

According to another aspect of the present invention, combustion and heating equipment includes a body in the lower part of which is located an underfeed stoker having a retort, a screw feeder arranged to feed fuel to the retort and extending through the body to an inlet, and a mobile fuel container connectible to the inlet.

Conveniently the mobile fuel container is sealable and may be refillable at a location remote from the combustion and heating equipment, thus allowing for greater cleanliness in the immediate vicinity of the equipment and affording improved amenity.

The container may be in the form of a hopper having a sealable inlet and an outlet for registering with the inlet of the screw feeder.

The container may be provided with wheels or other appropriate means for achieving mobility and latching means are preferably associated with the outlet of the container and the inlet of the screw feeder in order to maintain correct alignment during operation.

By way of example only, one embodiment of combustion and heating equipment according to the invention is described below with reference to the accompanying drawing which is a diagrammatic sectional view of the equipment. Referring to the drawing, combustion and heating equipment is shown at 1 and includes a body 2 provided with a jacket 4 to define annular heating space 6 for a working fluid, in this example air. At the lower end of the body 2 is located an underfeed stoker 8 comprising a retort 10 having tuyere ports 12. An automatic ignition device 14 is provided externally of the body 2 for generating hot gas used during initiation of combustion of solid fuel in the retort 10, the hot gas being conducted to the retort 10 by a conduit 16 extending thereinto below the top thereof.

A screw feeder 18 is driven by a drive arrangement 20 and consists of a reverse flight screw 22 within a casing 24 relieved in the vicinity of the retort 10 to allow access thereto by the fuel conveyed in use by the screw 22. The casing 24 and screw 22 extend right through the body 2 and terminate externally thereof remote from the drive arrangement 20. A plenum 21 is located beneath the retort 10 and feeder 18 and in use is supplied by air from a fan 23.

A mobile hopper 26 having a sealable inlet 28 and legs 30 provided with wheels 32 is as shown in the drawing in a position adjacent the body 2. The hopper 26 has an outlet 34 registering with an inlet 36 of the screw feeder 18, the screw 22 of which extends into the outlet 34 and thus into any fuel within the hopper 26.

A triangular section duct 40 extends across the interior of the body 2 and connects different parts of the heating space 6, the duct 40 being located above the stoker 8 in the gas pass 42 defined within the body 2 thereabove. A fan 44 is mounted exteriorly of the body 2 and is connected to the jacket 4 for communication with the heating space 6.

An overfire arch 46 is secured to the underside of the duct 40 which has an apex directed upwardly and disposed on the centre line of the body 2, the included angle in this example being 60°. The arch 46 is conveniently made of refractory material.

A further duct 50 also of triangular section is situated above duct 40 and is orientated at right angles thereto, duct 50 also interconnecting different parts of the heating space 6 which has an outlet 52 circumjacent a combustion gas outlet 54 in the body 2 at the top thereof, a flue 56 being connected to the outlet 54 for discharging waste gas products of combustion. In operation, solid fuel (not shown), e.g. coal, is held within the mobile hopper 26 the outlet 34 is in register with the inlet 36 of the screw feeder 18. Upon actuation of the screw feeder 18 by means of the drive arrangement 20, the flight screw 22 feeds coal from hopper 26 through the casing 24 and upwardly into the retort to form a fuel bed (not shown). In order to initiate combustion within the fuel bed, automatic ignition device 14, preferably electric, is activated and supplies hot gas through conduit 16 into the retort via the tuyere ports 12. When an incandescent fuel bed has been attained, the ignition device 14 is turned off and thereafter combustion of the fuel is self-sustaining. The overfire arch 46 assists the combustion intensity and efficiency in that heat is reflected therefrom thus promoting ignition of raw fuel as it emerges up through the retort 10.

As combustion proceeds, hot gases issue from the fuel bed and pass upwardly through the gas pass 42, flowing in contact with the body 2 release heat to air caused to flow through the heating space 6 by the fan 44. The gases also relinquish heat by transfer through the walls of the ducts 40 and 50 over and around which they pass, the triangular shape of the ducts causing turbulence in the gas flow thus ensuring great residence time in the body and thus greater heat transfer efficacy. The different orientations of the ducts 40 and 50 affording a cruciform configuration when viewed in plan also enhances turbulence in the gas flow and the apical angles of the ducts 40, 50 ensures that any particles entrained in the gas flow do not become lodged on the ducts, thereby affording a self-cleaning action.

The air passing through the heating space 6 and ducts 40, 50 is heated by the combustion gases and passes through outlet 52 for use either directly as atmospheric heating or may be routed to a particular point or system for use.

With regard to the replenishment of the coal in hopper 26, it is envisaged that a number of rechargeable hoppers for each piece of equipment would be provided whereby upon the hopper currently in use becoming empty, a fresh and full hopper would be moved into the position where the screw feeder could extract the coal for conveyance to the retort. The empty hopper would then be removed to a location whereat it could be recharged with coal. Preferably, such location would be remote from the site of the combustion and heating equipment, thus removing a potential source of contamination of the operating environment. More than one piece of equipment may be provided in a heating installation and accordingly hoppers of the type indicated would service more than one piece of equipment and would be replenished from a centralized coal storage point.

The present invention thus provides combustion and heating equipment which afford an enhanced heat transfer capability by virtue of the arrangement of the duct in the gas pass coupled with improved amenity by the provision of the mobile hopper.

I claim:

1. Combustion and heating equipment including a body having a lower part, a flue extending from said body an underfeed stoker located in said lower part, the stoker including a retort and a screwfeeder extending through the body to an inlet means, the screwfeeder incorporating a screw flight to reverse hand, a drive arrangement for the screwfeeder at one end thereof and a mobile fuel container at the other end thereof separate from said equipment, but connectible to said inlet means, a jacket extending around the body, a heating space defined between the body and the jacket, at least two ducts disposed within the body and spaced apart vertically above the underfeed stoker, said ducts extending through the body and positioned to interconnect different parts of the heating space, means for introducing a fluid to be heated and causing flow thereof through the heating space and through at least one of said ducts, an outlet means from the heating space and through the jacket for the fluid, and an overfire arch situated above the retort and below the ducts for reflecting heat back to the retort.

2. Equipment according to claim 1 in which each duct is of triangular section.

3. Equipment according to claim 1 in which successive ducts are orientated in different modes with respect to one another.

4. Equipment according to claim 3 in which successive ducts are arranged at right angles to one another.

5. Equipment according to claim 1 in which the apex of each triangular duct is arranged on the center line of the body in an upward direction.

6. Equipment according to claim 5 in which the included angle of the apex of each triangular duct is 60°.

7. Equipment according to claim 1 in which the overfire arch is attached to the duct means nearest to the underfeed stoker.

8. Equipment according to claim 1 in which the mobile fuel container is sealable.

9. Equipment according to claim 8 in which the container is in the form of a hopper having a sealable inlet means and an outlet means for registering with the inlet means of the screwfeeder.

* * * * *